United States Patent [19]

Götz

[11] 4,040,553

[45] Aug. 9, 1977

[54] INTERMITTENT STOCK FEED MECHANISM

[75] Inventor: Martin Götz, Sersheim, Germany

[73] Assignee: Erich Grau Stanzwerk fur Elektrobleche, Sersheim, Germany

[21] Appl. No.: 630,264

[22] Filed: Nov. 10, 1975

[30] Foreign Application Priority Data

Nov. 16, 1974 Germany ..... 2454514

[51] Int. Cl.[2] ..... B65H 17/22

[52] U.S. Cl. ..... 226/151; 226/154

[58] Field of Search ..... 226/154, 151, 147, 148, 226/149, 150, 155

[56] References Cited

U.S. PATENT DOCUMENTS

| | | | |
|---|---|---|---|
| 2,898,995 | 8/1959 | Funnell | 226/155 X |
| 2,946,588 | 7/1960 | Pityo | 226/154 X |

FOREIGN PATENT DOCUMENTS

| | | | |
|---|---|---|---|
| 551,966 | 11/1956 | Italy | 226/154 |

*Primary Examiner*—Bruce H. Stoner, Jr.

[57] ABSTRACT

The feeding mechanism serves to intermittently feed stock to a processing machine and comprises a rocker lever having at its outer end a gear segment, a crank drive comprising a crank which is operatively connected to said rocker lever, said crank drive being operable to impart an oscillation to said rocker lever, a feeding clamp comprising first and second, reversibly rotatable, toothed feed rollers arranged to mesh with each other when said feeding clamp is closed, said first feed roller being in mesh with said gear segment, a retaining clamp for holding said stock in position, and a cam operated control linkage for cyclically opening and closing said feeding clamp and retaining clamp in alternation.

6 Claims, 3 Drawing Figures

INTERMITTENT STOCK FEED MECHANISM

BACKGROUND OF THE INVENTION

This invention relates to a feeding mechanism for intermittently feeding stock to punching machines or presses.

Known feeding mechanism for intermittently feeding stock to punching machines or presses comprise a retaining clamp for holding the stock in position and a reciprocating feeding clamp, which consists of reversibly rotatable feed rollers. These clamps are cyclically opened and closed in alternation. An input crank drive of the mechanism is driven from the eccentric shaft of the machine through a 1 : 1 bevel gear train. The feeding stroke can be adjusted by a change of the throw of the crank. So far it has been possible to utilize only about 90° of the circumference of the crank-driven feed rollers for imparting a feed movement to the stock so that only relatively small feeding strokes can be obtained even with large feed rollers. Particularly with high-speed machines to be fed, it is also difficult to ensure a satisfactory cooperation of the retaining and feeding clamps as they open and close.

SUMMARY OF THE INVENTION

It is an object of the invention to provide a feeding mechanism which even when used to feed high-speed machines ensures with simple means a precisely controlled cooperation of the retaining and feeding clamps and to enable larger feeding strokes even where small feed rollers are employed in that each feed roller is used entirely or even repeatedly for a single feeding stroke.

In a feeding mechanism for intermittently feeding stock to punching machines or presses, comprising a retaining clamp for holding the stock in position, a feeding clamp comprising reversibly rotatable feeding rollers, which clamps cyclically open and close in alternation and an input crank drive driven by a bevel gear train from the eccentric shaft of the machine this object is accomplished in that the crank imparts an oscillation to a rocker lever, which has a gear segment in mesh with one of the two feed rollers, preferably with the lower one, and that the feed rollers are in toothed mesh when the feeding clamp is closed. The second feed roller, preferably the upper one is mounted together with the associated clamping jaw of the retaining clamp on a spring-biased forked lever, which is positively controlled by a camwheel to open and close the feeding and retaining clamps in alternation.

The camwheel is parallel to the crank disk and is embraced by a pivoted double roller bearing, which by means of a lever and link controls the forked lever. In this way a positive control is obtained. The forked lever is spring-biased to produce the contact pressure exerted by the feeding and retaining clamps. The shaft which carries the crank disk and the camwheel extends parallel to the stock path.

BRIEF DESCRIPTION OF THE DRAWINGS

An embodiment of the feeding mechanism according to the invention is shown by way of example on the drawings, in which.

DESCRIPTION OF THE PREFERRED EMBODIMENT

Figure 1:
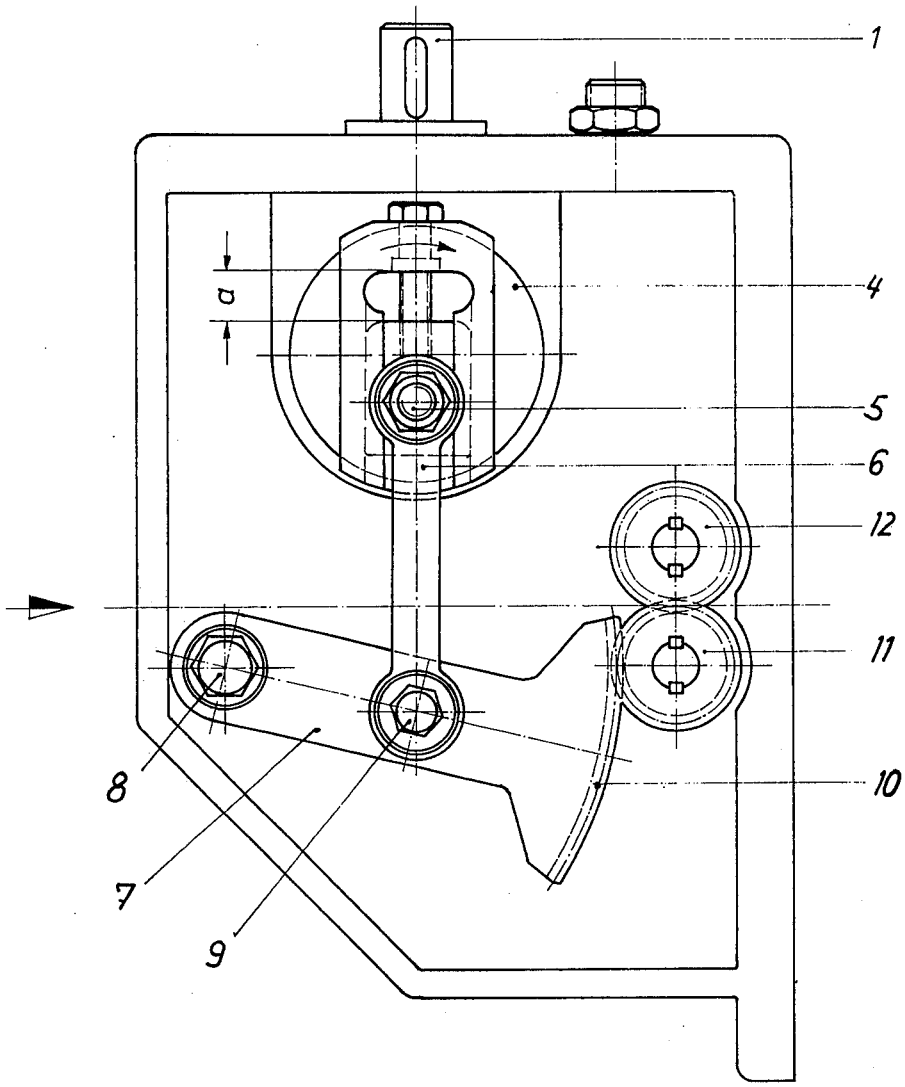
FIGS. 1 and 2 are two diagrammatic longitudinal sectional views taken on different planes extending through the mechanism and FIG. 3 is a transverse sectional view showing the mechanism.

The feeding mechanism is driven from the machine to be fed. Specifically, driving power is transmitted from an eccentric shaft of the punching machine or press through a 1 : 1 bevel gear train to the shaft 1, which drives the transverse shaft 3 through another bevel gear train 2. As is apparent from FIG. 1, a crank disk 4 is carried by the transverse shaft 3 at one end thereof and carries a crank 6 and means 5 for adjusting the throw of said crank. The crank 4 imparts a cyclic oscillation to the rocker lever 7 with an amplitude which depends on the crank throw. The rocker level 7 is pivotally suspended at 8 and connected to the crank at 9. The rocker lever 7 has at its outer end a gear segment 10, which is in mesh with the toothed lower feed roller 11, which is in mesh with the toothed upper feed roller 12 when the feeding clamp is closed. Depending on the selected adjustment, the circumference of each feed roller 11, 12 can be utilized entirely or repeatedly for feeding the stock during each feeding stroke.

Figure 2:
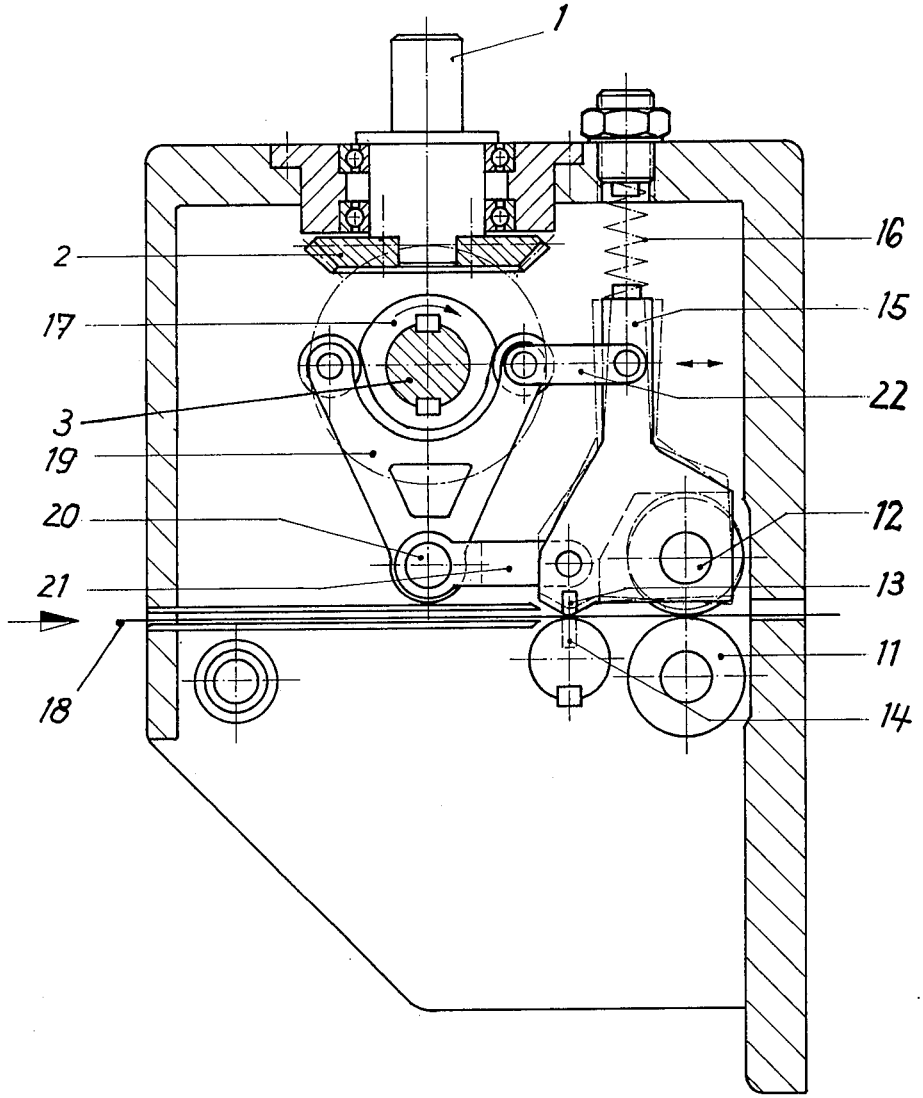
Figure 3:
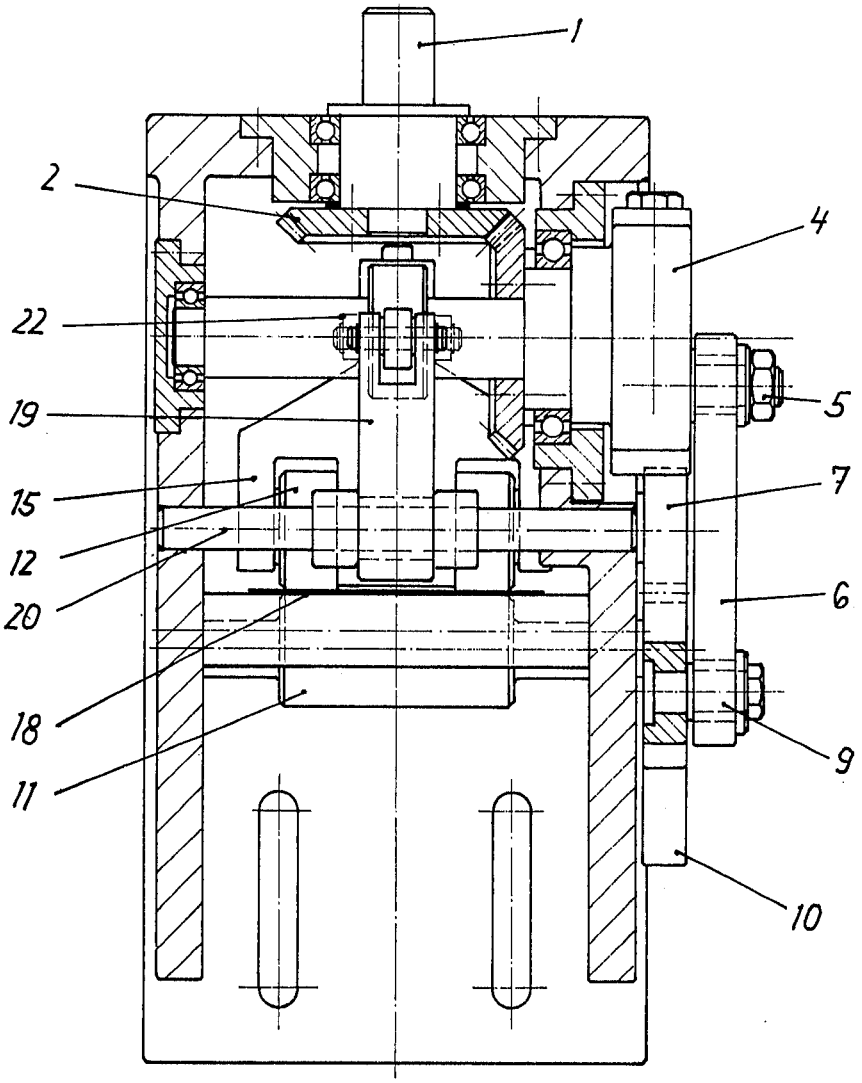

As is apparent from FIG. 2, the upper feed roller 12 and the upper clamping jaw 13 of the retaining clamp are mounted on a forked lever 15 independently of the stationary lower clamping jaw 14 of the retaining clamp. The forked lever 15 is biased by a spring 16 and is controlled by a camwheel 17 to open and close the feeding clamp 11, 12 and the retaining clamp 13, 14 in alternation to feed stock along the path 18. The camwheel 17 is mounted on the transverse shaft 3 and parallel to the camwheel 4. The double roller bearing 19 extends around the camwheel 4 and is pivoted at 20 and controls the forked lever 15 by means of a lever 21 and a link 22. The forked lever 15 is biased by a spring 16, which produces the contact pressure to be exerted by the feed roller 12 and the clamping jaw 13. Known means, not shown here, are provided for a temporary lifting of the clamping jaw 13.

What is claimed is:

1. A feeding mechanism for intermittently feeding stock to a processing machine, comprising a rocker lever having at its outer end a gear segment, a crank drive, including a crank which is operatively connected to said rocker lever, said crank drive being operable to impart an oscillation to said rocker lever, a feeding clamp, comprising first and second, reversably rotatable, toothed feed rollers arranged to mesh with each other when said feeding clamp is closed, said first feed roller being in mesh with said gear segment, a retaining clamp for holding said stock in position, said retaining clamp and said feeding clamp defining a stock path, said retaining clamp comprising first and second clamping jaws, disposed on the same sides of said stock path as said first and second feed rollers respectively, a forked lever carrying said second feed roller and said second clamping jaw, a cam wheel operatively connected to said crank drive, said cam wheel positively controlling said forked lever, to cyclically open and close said feeding clamp and said retaining clamp, in alternation, a pivoted roller bearing extending around and engaging said cam wheel and pivotable thereby, and means comprising a lever and a link for linking said double roller bearing to said forked lever, so that said double roller bearing controls said forked lever.

2. A feeding mechanism as set forth in claim 1, in which said feed rollers comprise a lower feed roller and an upper feed roller and said lower feed roller is in mesh with said gear segment.

3. A feeding mechanism as set forth in claim 1 in which said second feed roller and said second clamping jaw are disposed over said stock path and said first feed roller and first clamping jaw are disposed under said stock path.

4. A feeding mechanism as set forth in claim 1, further comprising spring means which bias said forked lever to urge said second feed roller and second clamping jaw against said first feed roller and said first clamping jaw, respectively.

5. A feeding mechanism as set forth in claim 1, in which said crank drive comprising a crank disk carrying said crank, and a shaft extending transversely to said stock path, and carrying said crank disk, and said cam wheel is mounted on said shaft, parallel to said crank disk.

6. A feeding mechanism as set forth in claim 1, wherein the opposing ends of said lever, and the opposing ends of said link, are pivotally connected to said double roller bearing and said forked lever respectively.

* * * * *